US007956588B2

(12) United States Patent
Imura

(10) Patent No.: US 7,956,588 B2
(45) Date of Patent: Jun. 7, 2011

(54) VOLTAGE REGULATOR

(75) Inventor: Takashi Imura, Chiba (JP)

(73) Assignee: Seiko Instruments Inc. (JP)

( * ) Notice: Subject to any disclaimer, the term of this patent is extended or adjusted under 35 U.S.C. 154(b) by 250 days.

(21) Appl. No.: 12/291,094

(22) Filed: Nov. 6, 2008

(65) Prior Publication Data

US 2009/0121690 A1 May 14, 2009

(30) Foreign Application Priority Data

Nov. 9, 2007 (JP) ..... 2007-291684
Oct. 6, 2008 (JP) ..... 2008-259956

(51) Int. Cl.
*G05F 1/44* (2006.01)
*G05F 1/56* (2006.01)

(52) U.S. Cl. ..... 323/274; 323/217

(58) Field of Classification Search ..... 323/273, 323/274, 280, 281, 217
See application file for complete search history.

(56) References Cited

U.S. PATENT DOCUMENTS 5,686,820 A * 11/1997 Riggio, Jr. ..... 323/273
7,068,018 B2 * 6/2006 Kanakubo ..... 323/274
2005/0162141 A1 7/2005 Kanakubo ..... 323/274

FOREIGN PATENT DOCUMENTS

JP 2005215897 8/2005

* cited by examiner

*Primary Examiner* — Gary L Laxton
(74) *Attorney, Agent, or Firm* — Adams & Wilks

(57) ABSTRACT

A voltage regulator has an error amplifier circuit, and a phase compensation circuit having a capacitor connected in parallel to first and second series-connected resistors. A control transistor has its source-drain path connected between input and output terminals of the phase compensation circuit and its gate connected to a junction point between the first and second resistors. In a transient stage in which the output voltage of the error amplifier circuit changes, the resistance of the phase compensation circuit decreases thereby improving the transient response characteristics of the voltage regulator.

5 Claims, 2 Drawing Sheets

FIG. 1
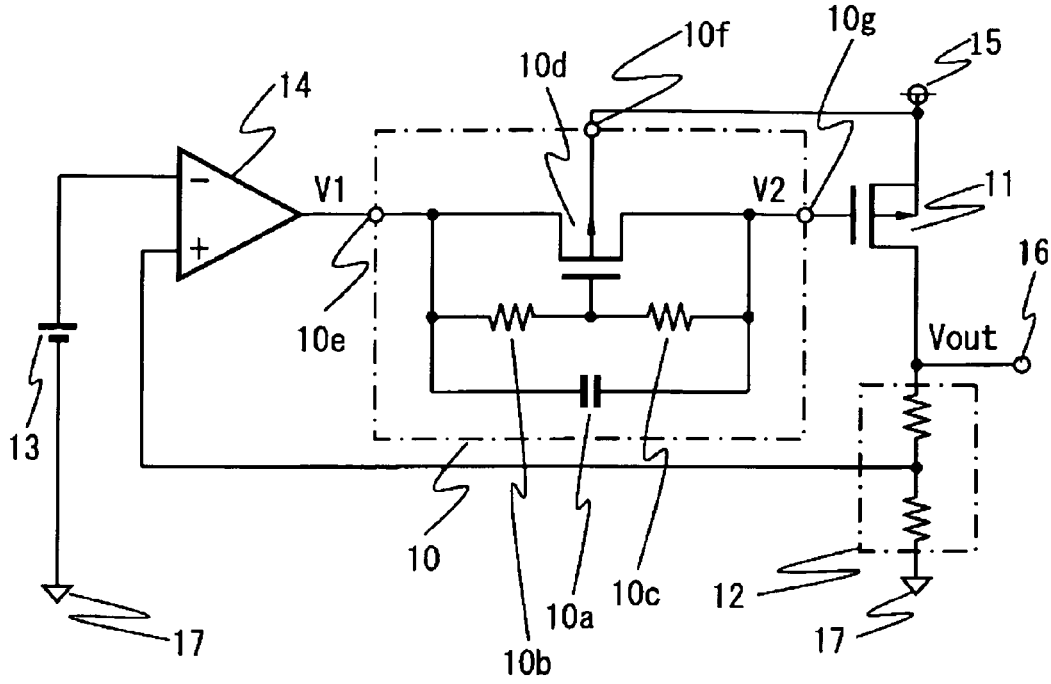
FIG. 2A
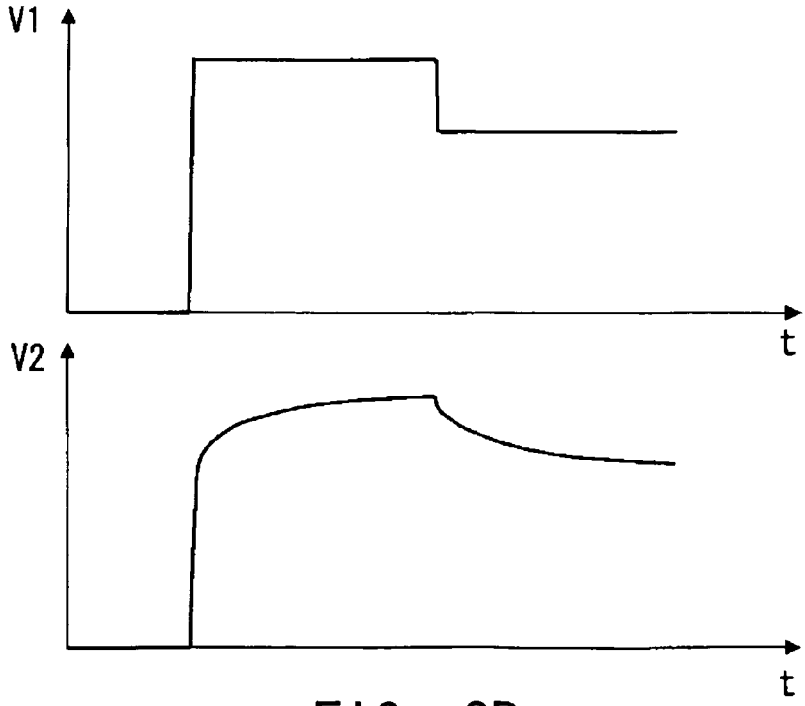
FIG. 2B

FIG. 3 PRIOR ART
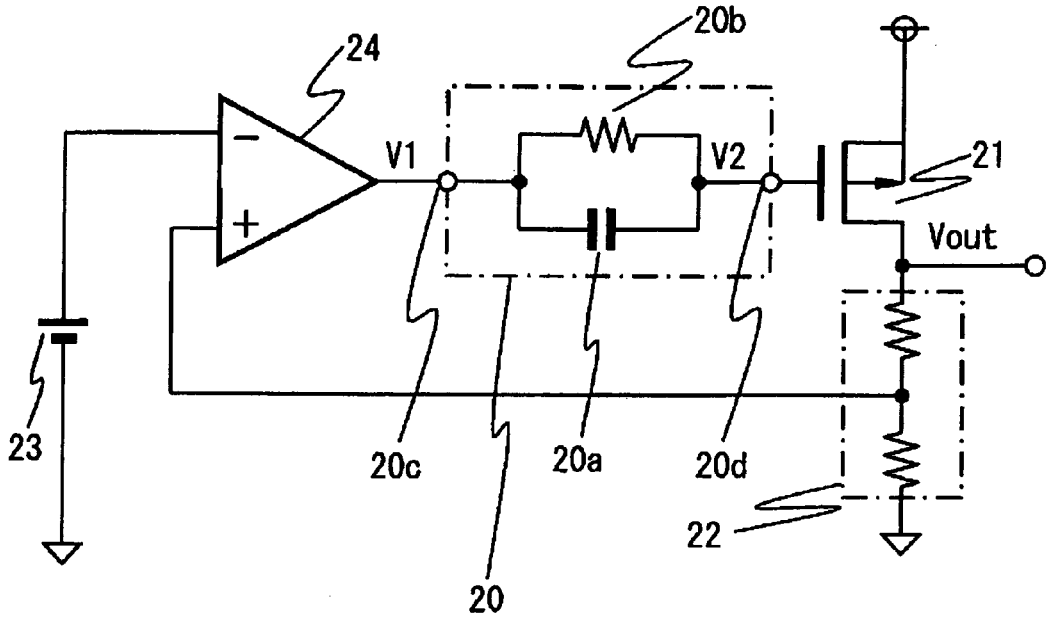
FIG. 4A PRIOR ART
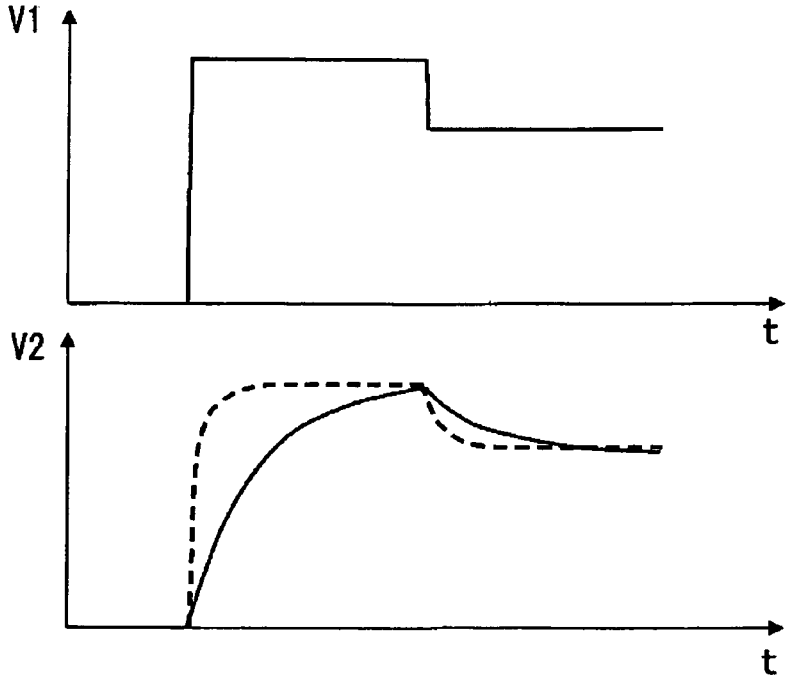
FIG. 4B PRIOR ART

VOLTAGE REGULATOR

BACKGROUND OF THE INVENTION

1. Field of the Invention

The present invention relates to a voltage regulator that outputs a constant output voltage, and more particularly, to a phase compensation circuit that stabilizes an operation of a voltage regulator.

2. Description of the Related Art

FIG. 3 is a circuit diagram illustrating a conventional voltage regulator.

The conventional voltage regulator includes an output transistor 21 that outputs an output voltage Vout, a voltage divider circuit 22 that divides the output voltage Vout, and a reference voltage circuit 23 that generates a reference voltage. The conventional voltage regulator also includes an error amplifier circuit 24 that controls the output transistor 21 so as to hold the output voltage Vout constant on the basis of the output voltage of the voltage divider circuit 22 and the reference voltage, and a phase compensation circuit 20 that is disposed between the output transistor 21 and the error amplifier circuit 24, and compensates a phase of an output terminal 20*d* of the phase compensation circuit 20. The phase compensation circuit 20 has a phase compensation capacitor 20*a* and a phase compensation resistor 20*b* (for example, see JP 2005-215897 A).

In the phase compensation circuit 20 of the voltage regulator, a resistance of the phase compensation resistor 20*b* may be set to be large in order to achieve a stable operation of the voltage regulator.

When the output voltage Vout of the voltage regulator changes, an output voltage of the error amplifier circuit 24 also changes. In a transient state in which the output voltage of the error amplifier circuit 24 changes, when the resistance of the phase compensation resistor 20*b* is large, it takes time to charge and discharge a gate of the output transistor 21.

FIGS. 4A and 4B are graphs each illustrating an input voltage and an output voltage, respectively, of the phase compensation circuit of the conventional voltage regulator.

When an input voltage V1 of the phase compensation circuit 20 changes as illustrated in FIG. 4A, an output voltage V2 of the phase compensation circuit 20 changes as illustrated in FIG. 4B. When the resistance of the phase compensation resistor 20*b* is small, the output voltage V2 changes as indicated by a dotted line in FIG. 4B. On the other hand, when the resistance of the phase compensation resistor 20*b* is large, the output voltage V2 changes as indicated by a solid line in FIG. 4B.

That is, there arises such a problem that transient response characteristics of the phase compensation circuit 20 are deteriorated, and therefore the transient response characteristics of the voltage regulator are deteriorated.

SUMMARY OF THE INVENTION

The present invention has been made in view of the above-mentioned problem, and therefore an object of the present invention is to provide a voltage regulator that is excellent in transient response characteristics even if a resistance of a phase compensation resistor is large.

In order to solve the above-mentioned problem, in the voltage regulator according to the present invention, a resistor of a phase compensation circuit is so configured as to change the resistance thereof according to a voltage across both ends of the resistor. In a transient state in which an output voltage of an error amplifier circuit changes, the resistance of the resistor in the phase compensation circuit is decreased, to thereby improve the transient response characteristics of the voltage regulator without sacrificing a performance of the phase compensation circuit.

In the voltage regulator according to the present invention, in the transient state in which the output voltage of the error amplifier circuit changes, the resistance of the resistor in the phase compensation circuit is decreased, to thereby improve the transient response characteristics of the phase compensation circuit. Accordingly, the resistance of the resistor in the phase compensation circuit can be set to be large, and the transient response characteristics of the voltage regulator are excellent.

BRIEF DESCRIPTION OF THE DRAWINGS

In the accompanying drawings:

FIG. 1 is a circuit diagram illustrating a voltage regulator according to the present invention;

FIGS. 2A and 2B are graphs each illustrating an input voltage and an output voltage, respectively, of a phase compensation circuit in the voltage regulator according to the present invention;

FIG. 3 is a circuit diagram illustrating a conventional voltage regulator; and FIGS. 4A and 4B are graphs each illustrating an input voltage and an output voltage, respectively, of a phase compensation circuit in the conventional voltage regulator.

DETAILED DESCRIPTION OF THE PREFERRED EMBODIMENT

FIG. 1 is a circuit diagram illustrating a voltage regulator according to the present invention.

The voltage regulator according to the present invention includes a phase compensation circuit 10, an output transistor 11, a voltage divider circuit 12, a reference voltage circuit 13, an error amplifier circuit 14, a power supply terminal 15, an output terminal 16, and a ground terminal 17. The phase compensation circuit 10 includes a phase compensation capacitor 10*a*, phase compensation resistors 10*b* and 10*c*, a control transistor 10*d*, an input terminal 10*e*, an input terminal 10*f*, and an output terminal 10*g*.

The phase compensation circuit 10 has the input terminal 10*e* connected to an output terminal of the error amplifier circuit 14, the input terminal 10*f* connected to the power supply terminal 15, and the output terminal 10*g* connected to a gate of the output transistor 11. The output transistor 11 has a source and a back gate connected to the power supply terminal 15, and a drain connected to the output terminal 16. The voltage divider circuit 12 is disposed between the output terminal 16 and the ground terminal 17, and an output terminal of the voltage divider circuit 12 is connected to a non-inverting input terminal of the error amplifier circuit 14. The reference voltage circuit 13 is disposed between an inverting input terminal of the error amplifier circuit 14 and the ground terminal 17.

The phase compensation capacitor 10*a* has one end connected to the input terminal 10*e* of the phase compensation circuit 10, and another end connected to the output terminal 10*g* of the phase compensation circuit 10. The phase compensation resistor 10*b* has one end connected to the input terminal 10*e* of the phase compensation circuit 10, and another end connected to a gate of the control transistor 10*d*. The phase compensation resistor 10*c* has one end connected to the gate of the control transistor 10*d*, and another end connected to the output terminal 10*g* of the phase compensation circuit 10. The control transistor 10*d* has a source connected to the input terminal 10*e* of the phase compensation circuit 10, a drain connected to the output terminal 10*g* of the phase compensation circuit 10, and a back gate connected to the input terminal 10*f* of the phase compensation circuit 10.

The voltage regulator described above operates as follows.

The output transistor 11 outputs an output voltage Vout. The voltage divider circuit 12 divides the output voltage Vout. The reference voltage circuit 13 generates a reference voltage. The error amplifier circuit 14 outputs a control signal that controls the output transistor 11 so as to hold the output voltage Vout constant on the basis of the output voltage of the voltage divider circuit 12 and the reference voltage.

When the output voltage Vout decreases, the output voltage of the voltage divider circuit 12 also decreases. When the output voltage of the voltage divider circuit 12 is lower than the reference voltage, an output voltage of the error amplifier circuit 14 and an input voltage V1 of the phase compensation circuit 10 decrease. Control is made to decrease a gate voltage of the output transistor 11 and increase the output voltage Vout according to the control signal through the phase compensation circuit 10. Further, when the output voltage Vout increases, the gate voltage of the output transistor 11 increases, and the output voltage Vout decreases under the control. Accordingly, control is made to keep the output voltage Vout constant.

Subsequently, a description is given of an operation of the phase compensation circuit 10 of the voltage regulator according to the present invention. The phase compensation circuit 10 compensates a phase of the control signal which is output from the error amplifier circuit 14. In particular, a capacitance of the phase compensation capacitor 10*a* and resistances of the phase compensation resistors 10*b* and 10*c* are so set as not to oscillate the voltage regulator.

First, a description is given of a transient state in a case where a voltage change of the output voltage Vout is small.

When a voltage drop of the output voltage Vout is small, a voltage difference between the input voltage V1 and an output voltage V2 of the phase compensation circuit 10 is small. Accordingly, since the control transistor 10*d* is off, the phase compensation circuit 10 is configured such that the phase compensation capacitor 10*a*, and the phase compensation resistors 10*b* and 10*c* are connected in parallel to each other.

Subsequently, a description is given of a transient state in a case where the voltage change of the output voltage Vout is large.

When the voltage drop of the output voltage Vout is large, the input voltage V1 of the phase compensation circuit 10 largely decreases. In this situation, when the resistance of the phase compensation circuit 10 is high, the voltage difference between the input voltage V1 and the output voltage V2 is large. The voltage difference is divided by the phase compensation resistors 10*b* and 10*c*, and then applied to the gate of the control transistor 10*d*, whereby the control transistor 10*d* turns on. Therefore, the phase compensation circuit 10 is configured such that the phase compensation capacitor 10*a*, the phase compensation resistors 10*b* and 10*c*, and the control transistor 10*d* are connected in parallel. In this state, since the control transistor 10*d* turns on, the resistance of a resistor between the input terminal 10*e* and the output terminal 10*g* of the phase compensation circuit 10 becomes small. That is, transient response characteristics of the phase compensation circuit 10 become excellent. Further, when an increase in the voltage of the output voltage Vout is large, the transient response characteristics of the phase compensation circuit 10 become excellent by turning on the control transistor 10*d* in the same manner as that described above.

FIGS. 2A and 2B are graphs each illustrating the input voltage and the output voltage, respectively, of the phase compensation circuit in the voltage regulator according to the present invention.

According to the phase compensation circuit of the present invention, when the input voltage V1 of the phase compensation circuit 10 changes as illustrated in FIG. 2A, the output voltage V2 of the phase compensation circuit 10 changes at rapidly as illustrated in FIG. 2B, as compared with FIG. 4B.

In this example, it is assumed that the input voltage of the phase compensation circuit 10 is V1, the output voltage is V2, and a threshold value of the control transistor 10*d* is Vthp. Then, when the resistances of the phase compensation resistors 10*b* and 10*c* are equal to each other, a condition under which the control transistor 10*d* turns on is given by Expression 1.

$$|V1-V2|/2>|Vthp| \quad (1).$$

When the resistances (resistance values) of the phase compensation resistors 10*b* and 10*c* are equal to each other, timing at which the control transistor 10*d* turns on is equal between when the output voltage Vout decreases and when the output voltage Vout increases. That is, in the transient state in which the output voltage Vout changes, transient response characteristics of the control transistor 11 are identical between when the output voltage Vout decreases and when the output voltage Vout increases.

Further, it is assumed that the resistance of the phase compensation resistor 10*b* is R1, and the resistance of the phase compensation resistor 10*c* is R2. Then, in a case where the resistances (resistance values) of the phase compensation resistor 10*b* and the phase compensation resistor 10*c* are different from each other, the condition under which the control transistor 10*d* turns on is represented by Expression 2 when the output voltage Vout decreases, and by Expression 3 when the output voltage Vout increases.

$$(V2-V1)\times R1/(R1+R2)>|Vthp| \quad (2)$$

$$(V1-V2)\times R2/(R1+R2)>|Vthp| \quad (3)$$

As described above, when the resistances (resistance values) of the phase compensation resistor 10*b* and the phase compensation resistor 10*c* differ from each other, adjustment can be made such that the transient response characteristics in the case where the output voltage Vout increases are excellent, or the transient response characteristics in the case where the output voltage Vout decreases are excellent.

The back gate of the control transistor 10*d* is connected to the power supply terminal 15. Alternatively, the back gate can be connected to a node whose voltage is higher than the voltage of the source and the drain other than the power supply terminal 15.

Further, the control transistor 10*d* is a PMOS transistor, but May be an NMOS transistor. In this case, the back gate of the control transistor 10*d* is connected to a node whose voltage is lower than the voltage of the source and the drain.

What is claimed is:

1. A voltage regulator, comprising:

an error amplifier circuit that amplifies and outputs a difference between a reference voltage and a voltage based on an output voltage of an output transistor to control a gate of the output transistor; and a phase compensation circuit that is disposed between the output transistor and the error amplifier circuit and that compensates a phase of an output signal of the error amplifier circuit, wherein the phase compensation circuit includes a phase compensation resistor and a phase compensation capacitor, wherein the phase compensation resistor comprises:

a first phase compensation resistor having one terminal connected to an input terminal of the phase compensation circuit;

a second phase compensation resistor having one terminal connected to another terminal of the first phase compensation resistor, and another terminal connected to an output terminal of the phase compensation circuit; and a control transistor having a source connected to the input terminal of the phase compensation circuit, a drain connected to the output terminal of the phase compensation circuit, and a gate connected to the another terminal of the first phase compensation resistor and the one terminal of the second phase compensation resistor; and wherein a resistance of the phase compensation circuit decreases in a transient state in which the output signal of the error amplifier circuit changes.

2. A voltage regulator according to claim 1, wherein the control transistor turns on in the transient state in which the output signal of the error amplifier circuit changes.

3. A voltage regulator according to claim 1, wherein the first phase compensation resistor has a resistance value equal to that of the second phase compensation resistor.

4. A voltage regulator according to claim 1, wherein the first phase compensation resistor has a resistance value higher than that of the second phase compensation resistor.

5. A voltage regulator according to claim 1, wherein the first phase compensation resistor has a resistance value lower than that of the second phase compensation resistor.

* * * * *